United States Patent [19]

Bisping

[11] Patent Number: 4,495,869

[45] Date of Patent: Jan. 29, 1985

[54] FUZELESS ANNULAR WING PROJECTILE

[75] Inventor: Bernhard Bisping, Ratingen, Fed. Rep. of Germany

[73] Assignee: Rheinmetall GmbH, Düsseldorf, Fed. Rep. of Germany

[21] Appl. No.: 361,452

[22] Filed: Mar. 24, 1982

[30] Foreign Application Priority Data

Mar. 25, 1981 [DE] Fed. Rep. of Germany ..... 3111725

[51] Int. Cl.[3] ..... F42B 13/18; F42B 13/00

[52] U.S. Cl. ..... 102/503; 102/493; 102/497

[58] Field of Search ..... 102/491-497, 102/503, 506, 364, 389, 501, 513, 517-519, 365, 473

[56] References Cited

U.S. PATENT DOCUMENTS

| | | | |
|---|---|---|---|
| 109,600 | 11/1870 | Drake | 102/493 |
| 1,303,727 | 5/1919 | Rice | 102/493 X |
| 3,946,673 | 3/1976 | Hayes | 102/517 X |
| 3,948,180 | 4/1976 | Silvia et al. | 102/519 |
| 4,112,846 | 9/1978 | Gilbert et al. | 102/517 X |
| 4,164,904 | 8/1979 | Laviolette | 102/503 |
| 4,212,244 | 7/1980 | Flatau | 102/520 X |
| 4,362,107 | 12/1982 | Romer et al. | 102/529 X |

*Primary Examiner*—Harold J. Tudor
*Assistant Examiner*—Tyrone Davis
*Attorney, Agent, or Firm*—Spencer & Frank

[57] ABSTRACT

A fuzeless annular wing projectile composed of a tubular projectile body having essentially smooth interior and exterior cylindrical faces extending in the longitudinal direction of the body, and a guide band mounted on the body with the body being formed and/or treated to exhibit desired break locations in the region of at least one face and at least at a location between the front end of the body and the location of the guide band.

8 Claims, 11 Drawing Figures

FUZELESS ANNULAR WING PROJECTILE

BACKGROUND OF THE INVENTION

The present invention relates to a projectile of the fuzeless annular wing type.

A projectile of this type is disclosed in German Offenlegungsschrift [Laid-Open Application] No. 2,712,807. This projectile has a comparatively low air resistance, or drag, which enables it to attain a trajectory traversed at high speed, and a sufficient bodily mass to assure a good penetration effect. These properties give it a certain suitability for use against flying targets, for example helicopters.

The drawback of the known projectle is that the damage which it can inflict on the target is essentially determined by its penetration capability. Thus significant damage to vital instruments or parts of the target in question is essentially a question of accident, even with good penetration, and consequently requires long bursts of fire so as to realize a sufficient probability of destruction.

SUMMARY OF THE INVENTION

It is an object of the present invention to provide a projectile of the above-described type which inflicts greater damage in the target after penetration due to splinter formation on the part of the projectile.

The above and other objects are achieved, according to the present invention, by the provision of a fuzeless annular wing projectile composed of a tubular projectile body having essentially smooth interior and exterior cylindrical faces extending in the longitudinal direction of the body, and a guide band mounted on the body, the body defining desired break locations in the region of one face and at least at a location between the front end of the body and the location of the guide band.

The invention will now be explained in greater detail with reference to ten embodiments which are illustrated in the drawing, essentially in schematic form and without details not relevant to the invention.

DESCRIPTION OF THE PREFERRED EMBODIMENTS

Figure 1:
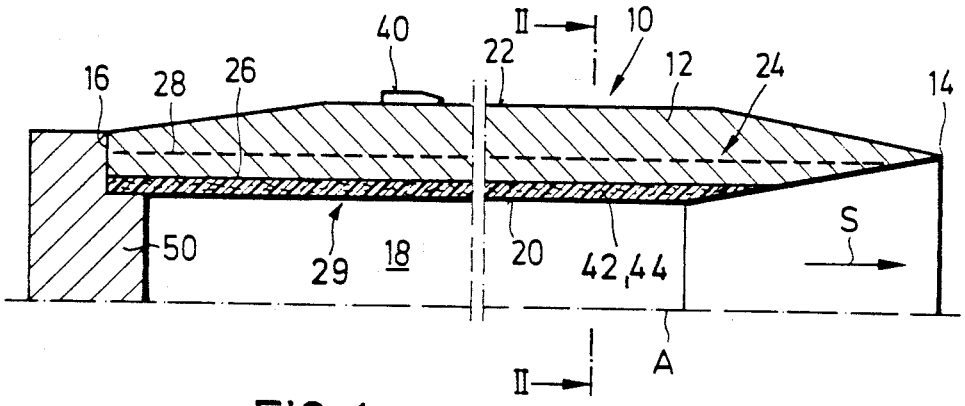
FIG. 1 is a cross-sectional view of one-half of a tubular projectile according to a first preferred embodiment of the invention seen along the longitudinal axis of the projectile.
Figure 2:
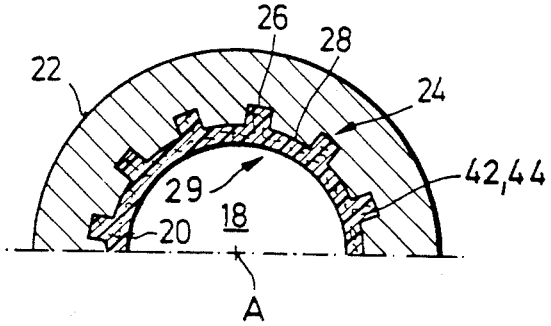
FIG. 2 is a cross-sectional view of the projectile along the line II—II of FIG. 1.

The embodiment of the invention shown in FIGS. 1 and 2 includes a tubular projectile body 10 constituted essentially by a wall 12. The projectile 10 is delimited at its frontal face by a bow section 14 and at its rear by a circular tail section 16, between which there extends a circular central bore 18. The circumference of the central bore is defined by an interior face 20 of the projectile body, which is radially spaced from an exterior face 22 of the body.

Desired break locations 24 are formed by providing grooves which locally reduce the thickness of the wall 12 in the region of the interior face 20. The grooves have bases 26 which constitute the parts of the interior surface of wall 12 most remote from the projectile axis and that interior surface is completed by parts 28 between the grooves and closer to the projectile axis. The grooves are filled with a mass of a hardened plastic 42 in which metal particles 44 are embedded. A coating 29 of the same plastic with embedded metal particles is then spread thereon to give the interior face 20 a smooth form. Advantageously, the particles 44 are made of a metal having pyrophoric properties, as will be explained below.

To stabilize its spin during flight, the projectile 10 is provided, on its exterior tube face 22, with a guide band 40 which is known per se and which will not be described in detail. The tail section 16 and the region of the bore 18 adjacent thereto serve as a receptacle for a sealing element 50 which seals the rear of the bore 18 when the projectile 10 is fired and passes through the barrel of a weapon. The rear surface of sealing element 50 forms part of a propelling gas pressure receiving face, not identified in detail.

Figure 3:
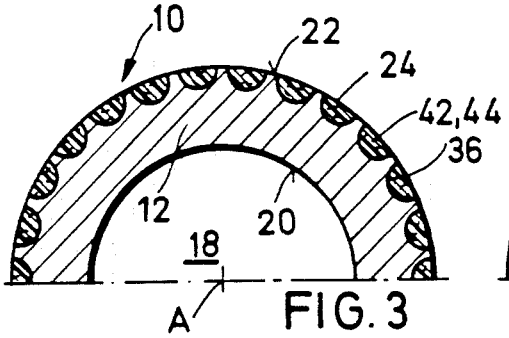
FIG. 3 is a view similar to that of FIG. 2 of a second embodiment with desired break locations in the form of rounded grooves on its exterior face.

As shown in FIG. 3, the projectile 10 according to a second embodiment of the invention is provided with arcuate cut-out recesses 36 in its exterior face 22 to produce desired break locations 24. These recesses 36 are again filled with hardened plastic 42 which—as already explained in connection with the first embodiment—contains metal particles 44 having pyrophoric properties. In the embodiment of FIG. 3, the interior face 20 of the bore 18 is formed directly by machining the material of the wall 12 of the projectile 10.

Figure 4:
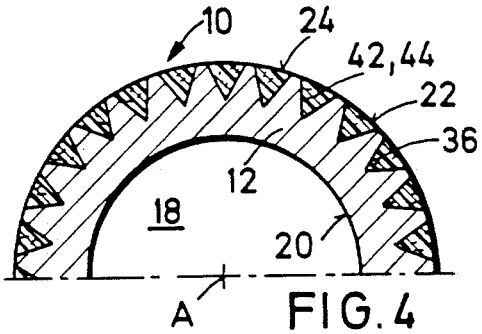
FIG. 4 is a view similar to that of FIG. 2 of a third embodiment with desired break locations in the form of grooves having an essentially triangular cross section on its exterior face.

In the embodiment shown in FIG. 4, the projectile 10 differs from that of FIG. 3 only by the form of the recesses 36 which, in FIG. 4, have an essentially triangular cross section.

Figure 5:
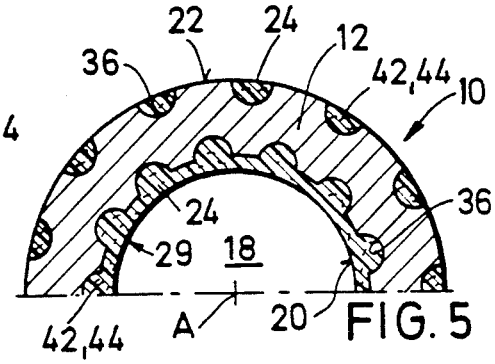
FIG. 5 is a view similar to that of FIG. 2 of a fourth embodiment having desired break locations in the form of rounded grooves on its interior face as well as on its exterior face.

In the embodiment of FIG. 5, the projectile 10 is provided with recesses 36 in the region of the interior face 20 of its bore 18 as well as in the region of the exterior face 22 so as to form desired break locations 24 at both surfaces of wall 12. The recesses 36 at both wall surfaces are rounded and filled with plastic 42 in which metal particles 44 are embedded so that the outer surface 22 of the tube is made smooth. The recesses 36 disposed in the region of the interior face of the bore 18 are filled with plastic 42 in which metal particles 44 are embedded, and a layer 29 similar to the embodiment of FIGS. 1 and 2 is applied to the filled recesses and the regions therebetween. The applied layer 29 is also a plastic 42 in which metal particles 44 are embedded.

Figure 6:
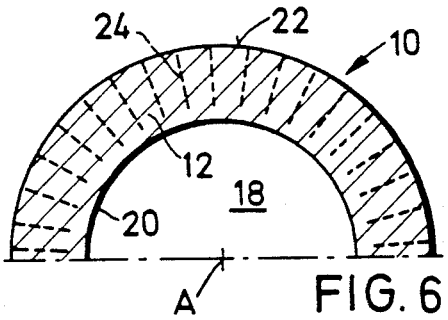
FIG. 6 is a view similar to that of FIG. 2 of a fifth embodiment of a projectile according to the invention in which the weakened portions are created in the form of very narrow grooves so as to produce the desired break locations.
Figure 7:
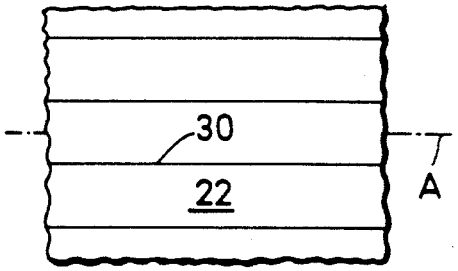
FIGS. 7 through 10 are developed views of the exterior surfaces of four further projectiles illustrating the different arrangements of desired break locations.

In FIG. 6 the desired break locations 24 in the form of very narrow grooves in the wall 12 are illustrated by full lines which lie on respective radii and are not identified in detail. Since depleted uranium has pyrophoric properties, the recesses 36 of dimension provided in the embodiments preceding FIG. 6 are not required so that the exterior face 22 after cutting said grooves only needs a thin coating, e.g. from polytetrafluorine-ethylene (Teflon), not illustrated, for the desired smoothness.

Figure 8:
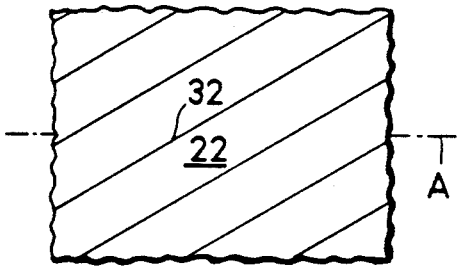

FIGS. 7 through 10 are developed views of the outer faces 22 projectiles according to four further embodiments of the invention. In the embodiment of FIG. 8, lines 30 extend parallel to the longitudinal axis A of the projectile. These lines 30 indicate the direction of recesses or narrow grooves, as shown in FIG. 6, to obtain the above-explained desired break locations.

In FIG. 8, lines 32 each form, in an easily recognizable manner, an angle with the longitudinal axis A of the projectile. These lines thus define one or more helical curves having the form, for example, of screw threads. Lines 32 show the arrangement of recesses or narrow grooves, as lines 30 of FIG. 7.

Figure 9:
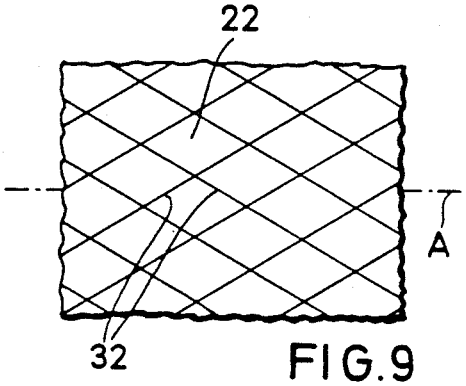

In the embodiment of FIG. 9, inclined lines 32 extend both clockwise and counterclockwise around the projectile. In this way, the desired break locations enclose parallelogram-shaped regions and thus lead to the formation of splinters whose shape is substantially predetermined.

Figure 10:
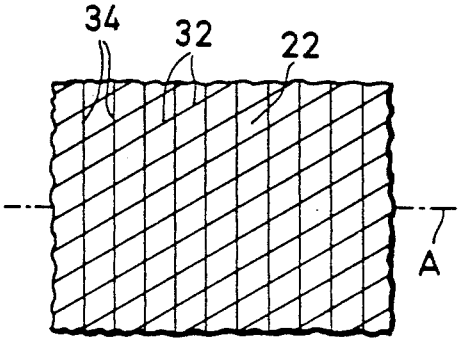

In the embodiment of FIG. 10, circumferential lines 34 are combined witn counterclockwise helical lines 32, with which they intersect. Lines 34 traverse the axis A of the projectile at an angle of 90°. In the embodiment of FIG. 10 as well, splinters are formed, as discussed in connection with FIG. 9, whose shape is essentially predetermined.

Figure 11:
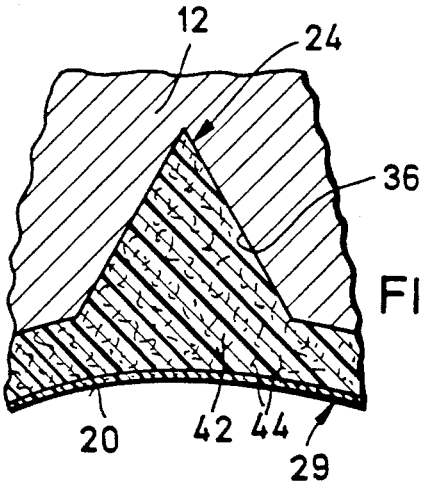
FIG. 11 is a cross-sectional view to an enlarged scale of the wall of a projectile, taken along a plane transverse to the longitudinal axis of the projectile and showing a desired break location in the form of a sharp-edged groove which is filled with metal particles embedded in plastic.

FIG. 11 shows a tenth embodiment which is quite similar to the first embodiment shown in FIGS. 1 and 2. However, in FIG. 11 the recesses 36 are provided in the form of grooves having an essentially triangular cross section. The enlarged scale view of FIG. 11 shows the metal particles 44 embedded in plastic 42 in the recesses 36 as well as in the applied layer 29.

When the projectile 10 hits a target, for example a helicopter, the projectile 10 penetrates a wall of the helicopter body. This substantially and suddenly reduces the spin of the projectile 10 and consequently its walls tear at the desired break locations 24 to generate a cone of splinters whose form depends on the type and arrangement of the desired break locations 24, on the final velocity of the projectile and on the residual spin. This increases the probability of hitting, with every single shot, a vital part disposed in the interior of the helicopter and enclosed by its hull to thus put the helicopter out of commision or destroy it. Since the fragments or splinters carry with them the plastic 42 with the pyrophoric metal particles 44 or the entire projectile 10 is made of a dense metal having pyrophoric properties, e.g. depleted uranium, easily combustible parts of the helicopter, for example the fuel tank, are particularly endangered.

To retain as much residual spin as possible, it is of advantage in connection with spin stabilized projectiles according to the invention, to make the circumferential region of the projectile 10 completely of as dense a material as possible. Particularly with spin stabilized projectiles according to the invention it is advantageous, in order to produce a broad splinter cone, to establish the highest possible inertial radius by locating the respective masses of the projectile 10 as far away as possible from the longitudinal axis A of the projectile.

In order to achieve splinter formation even on pentration of the thinnest aircraft skins, the projectile 10 is given the thinnest possible wall thickness. To avoid deformaton of such a projectile during firing when it is still in the barrell of the weapon, the weakened wall thickness in the wall region below the guide band 40 must be adapted to the respective strength considerations and requirements.

The plastic material 42 encases at least one pyrophoric metal with different particle sizes and shapes. This may be, for example, magnesium, zirconium, or depleted uranium. Zirconium may also be present, at least in part, as a sponge metal. Care must then be taken that the porosity of the sponge metal remains intact at least in part, i.e. that it is not compltely saturated by the matrix. The size of the particles 44 is within the range from μm up to mm. If powdered depleted uranium is used as a pyrophoric filler for the recesses the latter are preferably arranged from the inner surface of the bore 18 to avoid a loss by virtue of centrifugal force. The power may be pressed into the recesses and densified in a usual manner and secured by the above mentioned coating to obtain a smooth surface, as well.

A suitable material for the tubular projectile body 10 is a sintered alloy with a high tungsten content of at least 85 percent by weight, because of its high density, and a binder phase, for example iron and nickel. A further high density material is depleted uranium; since this material has a pyrophoric property, the desired break locations 24 formed by recesses or narrow grooves in the wall 12 may be filled with powdered depleted uranium, or tungsten, as well, in the above-mentioned manner to avoid an undesired loss in sectional density of the tubular projectile body 10.

It will be understood that the above description of the present invention is susceptible to various modifications, changes and adaptations, and the same are intended to be comprehended within the meaning and range of equivalents of the appended claims.

What is claimed is:

1. A fuzeless annular wing projectile comprising: a tubular projectile body having smooth interior and exterior cylindrical faces extending in the longitudinal direction of said body; and a guide band mounted on said body; said body having recesses which reduce the thickness of said body and constitute desired break locations in the region of at least one of said faces and at least at a location between the front end of said body and the location of said guide band; and wherein said body further comprises a hardened plastic material filling said recesses in order to give said one face a smooth form, and at least one metallic component embedded in said plastic material and made of a metallic material selected from among magnesium, zirconium, or depleted uranium.

2. Projectile as defined in claim 1 wherein said body is made of a sintered alloy containing a tungsten component, constituting at least 85 percent by weight of the alloy, and a binder phase containing nickel and iron.

3. Projectile as defined in claim 1 wherein said projectile body is made of depleted uranium.

4. Projectile as defined in claim 1, 2 or 3 wherein said desired break locations extend along mutually parallel lines across at least one of said faces.

5. Projectile as defined in claim 1 wherein said metallic component is in the form of different size particles.

6. Projectile as defined in claim 5 wherein said particles are in the form of powder grains, splinters, and/or chips.

7. Projectile as defined in claim 5 wherein said zirconium particles, at least partially, are present in the form of a sponge.

8. Projectile as defined in claim 7 wherein said particles are in the form of sponge metal whose porosity remains substantially intact when embedded in said plastic material.

* * * * *